United States Patent [19]

Klaus et al.

[11] 4,227,591

[45] Oct. 14, 1980

[54] MUFFLER FOR AIR-POWERED NAILERS AND THE LIKE

[75] Inventors: Arthur Klaus, Frankfurt am Main; Horst Tacke, Bad Vilbel, both of Fed. Rep. of Germany

[73] Assignee: Signode Corporation, Glenview, Ill.

[21] Appl. No.: 42,767

[22] Filed: May 29, 1979

[30] Foreign Application Priority Data

Jun. 21, 1978 [DE] Fed. Rep. of Germany ..... 2827279

[51] Int. Cl.[3] ..... F01N 1/08

[52] U.S. Cl. ..... 181/230; 181/272

[58] Field of Search ..... 181/230, 272, 275, 211, 181/212, 243, 264, 268, 269

[56] References Cited

U.S. PATENT DOCUMENTS

| | | | |
|---|---|---|---|
| 3,255,844 | 6/1966 | Wallace | 181/230 |
| 3,650,354 | 3/1972 | Gordon | 181/269 |
| 3,815,705 | 6/1974 | Bennett | 181/230 |
| 4,068,987 | 1/1978 | Crooks | 181/230 |

*Primary Examiner*—L. T. Hix
*Assistant Examiner*—Benjamin R. Fuller
*Attorney, Agent, or Firm*—Dressler, Goldsmith, Shore, Sutker & Milnamow, Ltd.

[57] ABSTRACT

The present invention relates to a novel outlet air muffler for air-powered transportable driving tools such as nailers. The muffler includes an outlet air duct formed in a housing endpiece and the top lid of the nailer. The outlet air duct is made up of two like chamber systems whose chambers are joined together by wall hollows. The chambers are furthermore interconnected through holes leading from the outlet side of the main control valve.

7 Claims, 3 Drawing Figures

FIG. 2
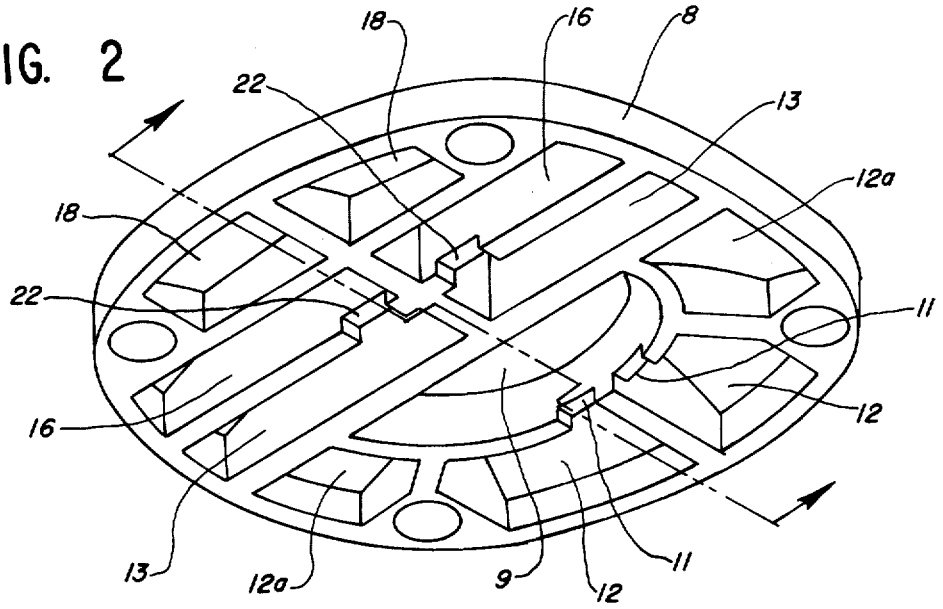
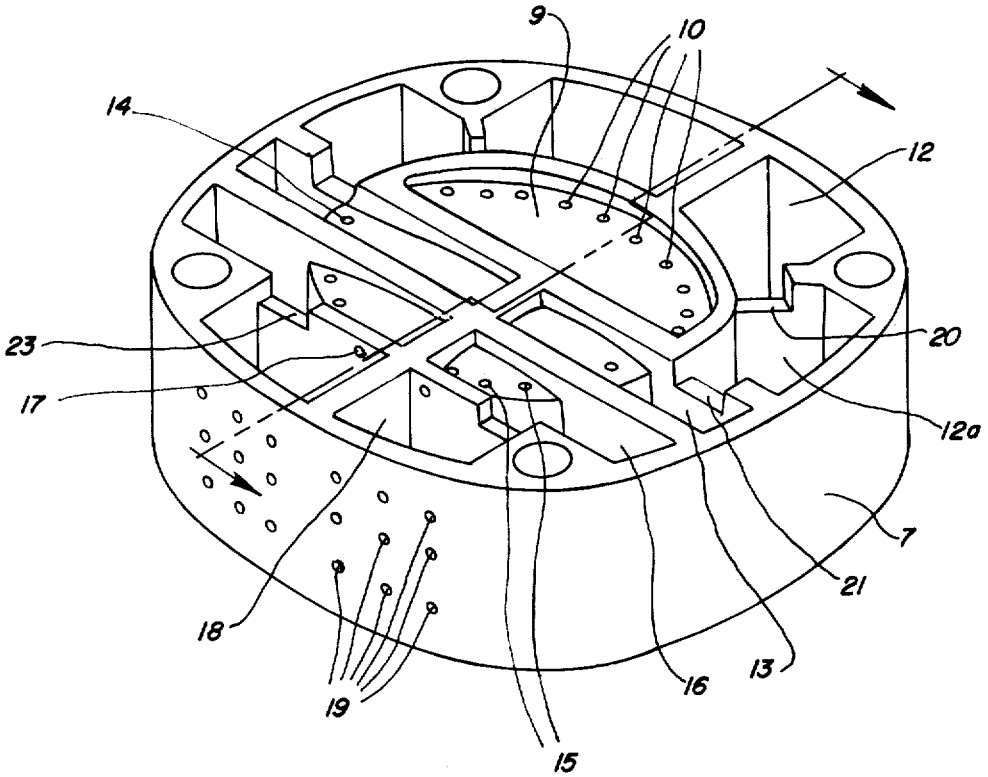
FIG. 3

MUFFLER FOR AIR-POWERED NAILERS AND THE LIKE

BACKGROUND OF THE INVENTION (1) Field of the Invention

The invention relates to an outlet air muffler for portable air-powered driving tools, made up of an outlet air duct arrangement, which is formed by the housing end and top lid of the driving tool, which interconnects the outlet side of the main control valve and the outside air.

(2) The Prior Art

Air-powered driving tools are normally worked with, generally speaking, high pressures of 6 to 8.5 bar. The compressed air is let into a cylinder space by control valves so that the working piston is axially moved and a driving rod, fixed to the bottom side of the working piston, has the effect of driving a fixing part (a staple or nail) out of the outlet duct into a workpiece. In the further working operation of this sort of tool, the main and control valves are operated so that the working compressed air in the working pressure space is responsible for moving the working piston between the driving and driven positions and high pressure air is subsequently exhausted into the outside air. On the exhausting of the compressed air, turbulence is produced and with it high frequency noise damaging to the ear. For putting an end to such noise or decreasing it, new designs of compressed air tools have been made with outlet mufflers having the purpose of so decreasing the air speed that no noise damaging to the ear is produced.

Outlet air mufflers have been put forward for air-powered driving tools that are limited in operation because such air-powered driving tools, to be portable handworked tools, are limited in their design size. So more special use has been made of diffusion mufflers which are mainly made up of tightly packed sintered material, plastics, bronze or steel wool. These diffusion mufflers have however the important shortcomings that they are readily put out of order by dirt which makes for a narrowing of the air cross sections as time goes on and for this reason the outlet air speed and furthermore the backward speed of the working piston is steadily decreased. These mufflers seem to be especially likely to be put out of order when used with wet air and, more especially, in cold seasons of the year, because ice is formed with the high air speeds, this having the same braking effect whose outcome may be that the tool may no longer be used. Furthermore, in some cases there will be danger to the user because under the high pressure, parts of the sintered metal will be violently broken off possibly wounding nearby persons. Furthermore, reflection mufflers have been designed, which however have not so far been used for a compressed air plant, because to get a good muffling effect, they have to be such a large size that they are not able to be used with portable plants.

SHORT ACCOUNT OF THE INVENTION

One purpose of the invention is that of designing an outlet air muffler for air-powered driving tools, which puts an end to the shortcomings of old systems. Its design size is such as not to substantially increase the volume of a portable driving tool.

For effecting this purpose the outlet air duct is made up of two like chamber systems, which have a number of chambers that are joined with each other by way of wall hollows, which are joined through holes interconnected with the outlet side of the main control valve.

Because of this design of the air outlet duct, the outlet air undergoes division into two air currents and expansion in the separate chambers. Since the one air current has the effect of limiting the other one and the other way around, the outlet air is braked before getting to the outside air to such an extent that no noise damaging to the ear is able to be produced. The energy of the moving air is, for this reason, not taken up by diffusion in a porous material or in large-sized reflection chambers and is in fact taken up by the air currents getting in each other's way.

The two chamber systems are more specially designed starting from a middle chamber, which is joined through holes with the outlet side of the main control valve. In this case, more than 50% of the outgoing amount of air goes into the middle chamber.

In accordance with the invention, the separate chambers are designed with a size in line with the amount of air going into them.

The wall hollows between the separate chambers are best placed alternately in the end of the housing and in the top lid so that the air currents have their direction changed with a braking effect. In this respect, it makes for a better design if the holes in the inbetween chamber and in the front current chamber are so placed that they are in the way of the air currents coming through the wall hollows from the chamber coming before.

More especially, a hole going into the outlet chamber has a diameter which is about half as great as that of the other holes.

LIST OF DIFFERENT VIEWS OF THE DRAWINGS

A detailed account will be given of one special form of the invention to be seen in the drawings.

FIG. 2 is a perspective view of the top lid of the driving tool of FIG. 1, looking at it from below and at a slope; and FIG. 3 is a perspective view of the housing end of the driving tool of FIG. 1, looking at it on a slope from above.

ACCOUNT OF SPECIAL FORMS OF THE INVENTION

Figure 1:
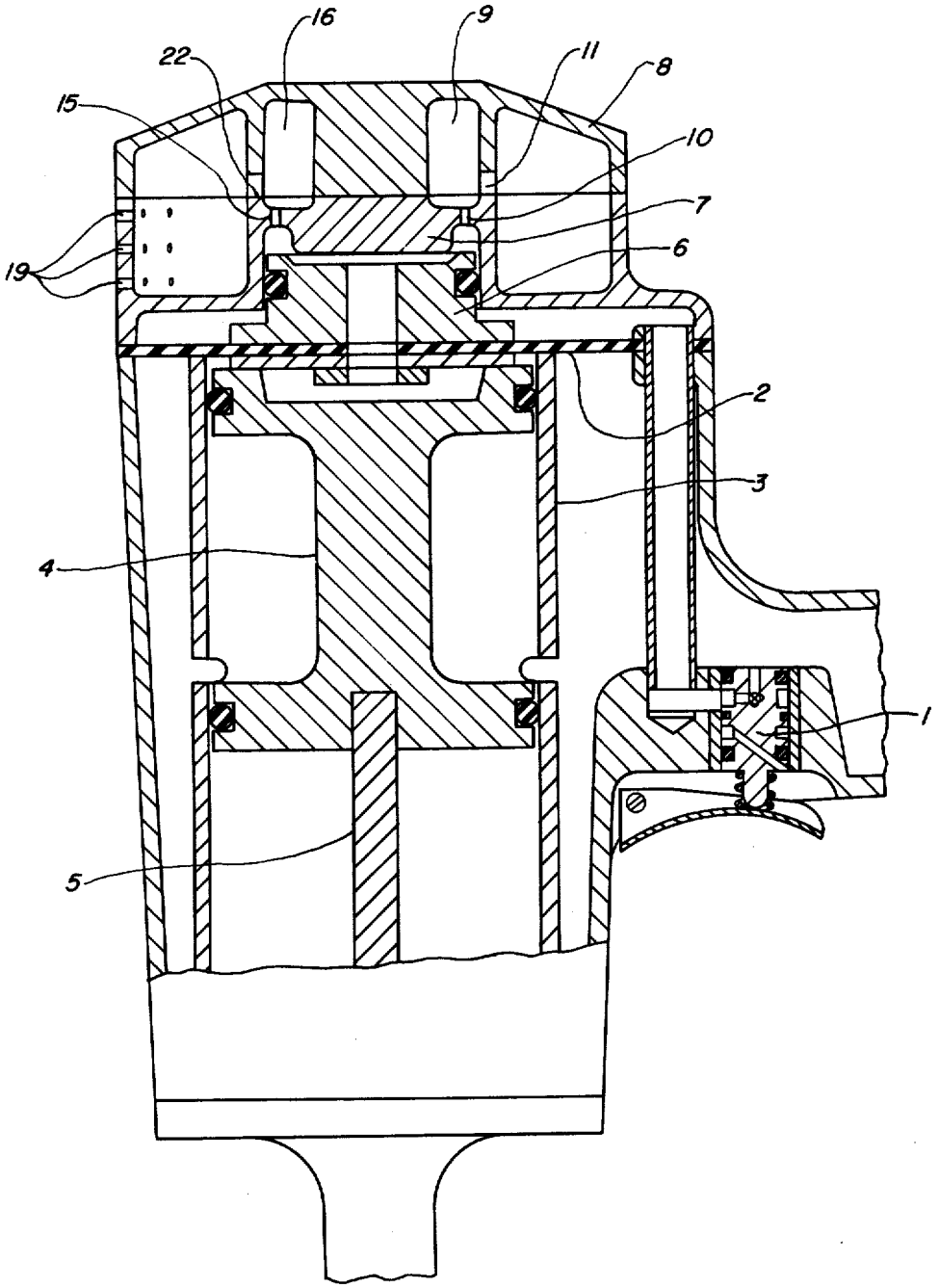
FIG. 1 is a long-section through a portable air-powered driving tool.

In FIG. 1 we have a portable air-powered driving tool as, for example, a compressed air nailer of normal design with a user-worked valve 1, a main control valve 2 and a cylinder 3 in which there is a working piston 4 moving axially and having a driving pin 5. Over the main control valve 2, to which a pilot piston 6 is connected, a housing end 7 or endpiece is fixed. The endpiece 7, together with the top lid 8, has the effect of forming two like chamber systems. These two chamber systems are produced by the joining together of the housing endpiece 7 and the top lid 8, because the walls, produced in them by casting, are in line with each other. As we are able to see from FIGS. 2 and 3, the two chamber systems have a common half-moon-like middle chamber 9, into which the greatest part of the air goes through holes, which comes out on upward movement of the working piston. On coming out of this middle chamber 9, the compressed air undergoes division into two separate air currents moving through the two chamber systems to the outside air. Each of these two chamber systems is made up of a current chamber 12, chamber 16 and an outlet chamber 18. The middle chamber 9 is joined by two wall hollows 11, formed in the top lid 8, with the two current chambers 12, which for their part are joined with the further chambers 12*a* through wall hollows 20 formed in the housing endpiece 7. The further chambers 12*a* are joined through wall hollows 21, formed in the housing endpiece 7, with the inbetween chambers 13, joined through wall hollows 22, formed in the top lid 8, with the front current chambers 16. The front current chambers 16 are in turn joined through wall hollows 23, formed in the housing endpiece 7, with the outlet chamber 18, which are joined with the outside air through holes 19.

Further compressed air comes through a hole 14 into the inbetween chamber 13 of the chamber system straightway from the outlet side of the main control valve 2. Right on the outlet side of the main control valve 2 further air currents go through holes 15 into the front current chamber 16, while through a hole 17 a smaller size compressed air goes from a position right at the outlet side of the main control valve 2 into the outlet chamber 18, from which position the compressed air lastly goes through the holes 19 into the air outside.

After changing over the position of the main control valve 2, the compressed air goes out of the cylinder space mainly through the holes 10 into the middle chamber 9 and it then undergoes division into two air currents by the hollows 11 in the top lid 8. Each of these two air currents goes through the wall hollow 11 into its current chamber 12, from it through the wall hollow 20 into the further chamber 12*a*, from the chamber 12*a* through the wall hollow 21 into the inbetween chamber 13 and from this chamber 13 through the wall hollow 22 into the front current chamber 16 and from the chamber through the wall hollow 23 into the outlet chamber 18, from which the compressed air lastly goes through the holes 19 into the outside air. In this respect the speed of motion of the air is slowed down not only by the expansion in the chambers themselves but furthermore by the inlet of compressed air through the holes 14, 15, and 17 on the outlet side of the main control valve 2 into the chamber system in the chambers 13, 16, and 18, so that the speed of motion of the air going out of the holes 19 is decreased to such a degree that outside the muffler parts no noise is produced damaging to the ear. The sound muffler parts, that is to say, the housing endpiece 7 and the top lid 8, are more specially made of aluminum, although other materials with the same sort of properties may be used.

Although an account of the invention has been given in connection with a compressed air nailer, the invention may be used with good effect in other compressed air tools.

What is claimed is:

1. In an air outlet muffler for the compressed air exhausted from the outlet side of a main control valve of a portable air-powered driving tool comprising air outlet duct means formed by a housing endpiece and a top lid of the driving tool, and in which the outlet side of the main control valve is joined with the outside air by the air outlet duct, the improvement consisting of the muffler having chambers joined with each other through wall hollows and wherein at least two of the chambers are joined directly through holes leading from the outlet side of the main control valve.

2. The structure as in claim 1, in which two separate divided chamber systems are placed running from a middle chamber, which is joined through holes with the outlet side of the main control valve.

3. The structure as in claim 2, characterized in that the middle chamber is designed for taking up more than 50% of the air to be exhausted.

4. The structure as in claim 2, in which the separate chambers are designed with sizes dependent on the amount of compressed air going into them and the outlet chamber opening into the outside air.

5. The structure as in claim 1, in which the wall hollows between the separate chambers are alternately made in the housing endpiece and in the top lid so that the directions of the air currents are changed.

6. The structure as in claim 1, in which the holes in the various chambers are so placed that they are in the way of air currents coming through the wall hollows from adjacent chambers.

7. The structure as in claim 2, characterized in that the hole placed running into the outlet chamber has a diameter about half as great in size as the hole leading to the atmosphere.

* * * * *